United States Patent [19]

Koch et al.

[11] 4,429,628

[45] Feb. 7, 1984

[54] EXTRACTION DEVICE

[75] Inventors: Klaus Koch, Laatzen; Gerhard Syrbius, Grossburgwedel, both of Fed. Rep. of Germany

[73] Assignee: Hermann Berstorff Maschinenbau GmbH, Hanover, Fed. Rep. of Germany

[21] Appl. No.: 326,477

[22] Filed: Dec. 2, 1981

[30] Foreign Application Priority Data

Dec. 9, 1980 [DE] Fed. Rep. of Germany ..... 3046384

[51] Int. Cl.³ ..... B30B 9/14

[52] U.S. Cl. ..... 100/117; 100/150

[58] Field of Search ..... 100/37, 117, 145, 146, 100/147, 148, 149, 150, 93 S; 366/77, 90, 89

[56] References Cited

U.S. PATENT DOCUMENTS

| | | | |
|---|---|---|---|
| 1,333,249 | 3/1920 | Fiddyment | 100/117 |
| 2,997,943 | 8/1961 | Zies | 100/117 X |
| 4,024,168 | 5/1977 | Homann et al. | 100/93 S |
| 4,199,263 | 4/1980 | Menges et al. | 366/90 |

FOREIGN PATENT DOCUMENTS

| | | |
|---|---|---|
| 1846103 | 2/1962 | Fed. Rep. of Germany . |
| 2456187 | 11/1974 | Fed. Rep. of Germany . |

*Primary Examiner*—Peter Feldman

*Attorney, Agent, or Firm*—Schwartz, Jeffery, Schwaab, Mack, Blumenthal & Koch

[57] ABSTRACT

An extraction device for extracting liquids from liquid-solid mixtures comprising a screw rotatable in a barrel the screw having at least one flight helically disposed thereon to define the screw thread, the flight having gaps formed therein, the gaps being dimensioned so as to correspond to the diameter of pins extending radially through the barrel towards the screw axis, the pins having axial bores formed therein for the discharge of liquid the bores being open in the direction of the axis of the screw. The bores are connected to a liquid discharge network.

10 Claims, 3 Drawing Figures

EXTRACTION DEVICE

BACKGROUND OF THE INVENTION

The present invention relates to an extraction device for separating the liquid components from solid components in a liquid-solid mixture.

A known extraction device comprises a drivable screw which is rotatable in a press barrel, a screw flight helically disposed thereon, and radially extending pins which extend into the press barrel in the direction of the screw axis. The pins extend substantially to this axis although their depth of penetration is adjustable. Gaps are formed in the flights which correspond to the diameter of the pins.

In U.S. Pat. No. 3,981,658, there is disclosed a device for extracting liquids from solid-liquid mixtures which has pins protruding through the press barrel. Such pins extend radially to the screw and prevent the material to be extracted from rotating with the screw. Such pins cause an adequate conveying pressure to be built up.

The present invention seeks to provide an extraction device whereby extracted liquid may be discharged directly from the site at which it is extracted without a substantial drop in pressure occurring due to such discharge. This pressure drop occurs in known filter presses.

According to the present invention, there is provided an extraction device for separating liquid components from the solid components of a liquid-solid mixture, comprising a drivable screw rotatable in a press barrel, a screw flight helically disposed on the screw and a plurality of radially directed pins which extend into the press barrel and are directed towards the longitudinal axis of the screw, the pins extending substantially to the base of the screw thread, the screw flight having a plurality of gaps formed therein, the gaps being so dimensioned that, in an axial direction, the width of the gaps corresponds to the diameter of the pins, wherein an axially extending bore is formed in each pin, the bores being open in the direction of the longitudinal axis of the screw and being in communication with a network for the discharge of the extracted liquid component.

The provision of discharge bores extending axially in the pins and which are open in the direction of the screw axis and which are connected to a discharge network enables the extracted liquid to be discharged at the site at which it is produced, without a substantial pressure drop being caused by the discharge apertures.

The pins prevent the material from rotating with the screw, so that a high conveying output is achieved and consequently a high pressure is built up in the pin-barrel region. Because of the high pressure, the water contained in the cells of the solid components of the material can be extracted. Accordingly, beet leaves, beet slices and sludge can be extracted, the liquid being released and easily discharged through the discharge bores formed in the pins. This is because there is a high drop in pressure of, for example, from 300 bars which is the pressure in the press barrel and 1 bar (atmospheric pressure) in the discharge bores.

Since the spacing of the tips of the pins from the bottom of the screw thread is relatively small, for example in a practical arrangement 0.3 mm, it is also possible for minute solid particles, which do not block the discharge bores, to be simultaneously discharged. The tips of the pins are adapted to the rounded shape of the core of the screw.

Advantageously, the pins are located between helical portions of the flights, the flights having radially extending bores formed therein, the radial bores being connected to an axial bore formed in the interior of the screw.

Such a measure makes it possible for the extracted liquid lying in the bottom of the screw thread to pass into the discharge bores formed in the pins and for the extracted liquid located adjacent the internal surface of the barrel to be discharged over the flight ridges, through the radial bores in the flights and into the axial bore in the screw. Such an arrangement means that substantially all of the extracted liquid is immediately collected and discharged whilst no substantial drop in pressure occurs in the barrel itself due to the discharge of the liquid.

Desirably, the press barrel has at least one region provided with at least one internal groove, the pins being located in the at least one grooved region. Such internal grooves are, for preference, axial grooves but may also be helical grooves corresponding to the pitch of the flights or extending in a direction counter to the pitch of the flights. The grooves may be triangular, rectangular or semi-circular in cross-section.

Preferably, a plurality of pins are combined to form a pin plane, the individual pins in each plane being disposed at equiangularly spaced intervals around the periphery of the press barrel, each pin being capable of being screwed into the press barrel and the depth of insertion of the pins into the barrel being adjustable.

Such an arrangement also makes it possible for the conveyance of the material to be maintained between the individual pin planes, because the grooves in the barrel prevent the material from rotating with the press screw. Because of this intensified conveying effect, a high pressure is produced which is essential for effective extraction. A high enough pressure enables the water contained in the cells of the solid components to be released and consequently permits high dry-substance contents to be achieved in a single operation in a continuous manner. Such an arrangement also ensures that the extracted liquid is discharged at the site where it is extracted without any substantial drop in pressure occurring in the barrel.

The combination of a plurality of pins, each provided with a discharge bore, to form one or more pin planes, makes it possible for the extracted liquid to be extracted peripherally at a plurality of locations. The adjustability of the pins with regard to their depth of insertion does, of course, produce a change in the conveying output and hence a change in the build-up of pressure. However, it permits the extraction device to be adapted to extract liquids from mixtures in which the solid components are of different sizes.

Further advantageously, the pins each have a tip portion capable of sliding on the base of the thread of the screw, the tip portions being made of a material having dry-running properties. Thus, the tips may be made of bronze. This ensures a long, relatively wear-free useful life for the tips of the pins.

Further desirably, small-bore tubes are inserted into the end region of discharge bores formed in the pins facing the screw, the tubes being conically inwardly tapering in a direction towards the screw. This makes it possible for the inlet apertures of the bores to be of small diameter. Such a measure counteracts the blocking of the bores in the pin bores and hence in the discharge system in communication therewith.

Further preferably, at least the portions of the pins which extend into the interior of the press barrel are of rectangular or polygonal cross-section. Such an arrangement provides a shearing effect which causes the cutting-up of solid particles as the particles are conveyed between the gaps in the flights and the pin members.

BRIEF DESCRIPTION OF THE DRAWINGS

Preferred embodiments of the present invention will be further described, by way of example, with reference to the accompanying drawings, in which.

DESCRIPTION OF THE PREFERRED EMBODIMENTS

Figure 1:
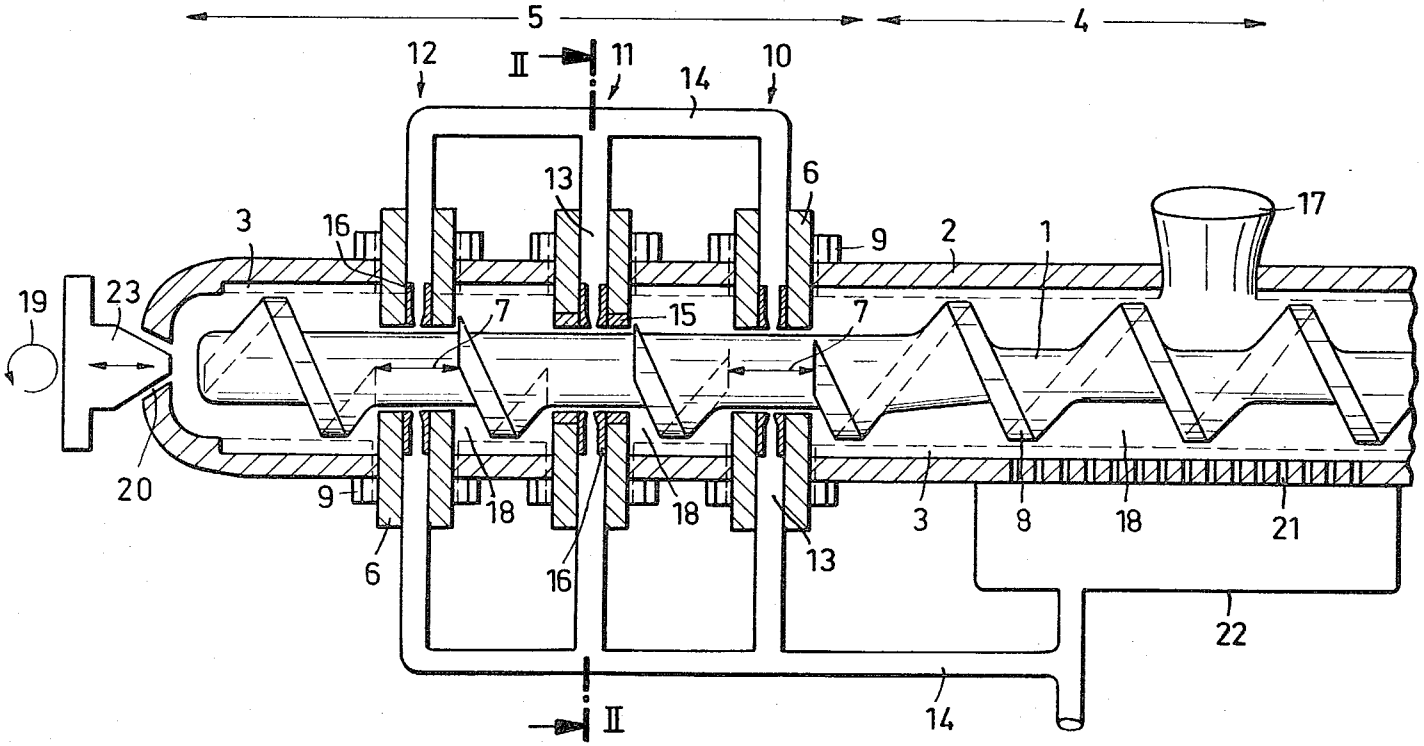
FIG. 1 is a diagrammatic longitudinal section through an extraction device in accordance with the present invention.

In the drawings, there is shown a rotatable extraction screw 1 which is disposed in a press barrel 2. The screw is rotated in the direction of arrow 19 by a drive unit (not shown). This causes material to be extracted to be conveyed forwardly (from right to left as seen in FIG. 1) towards an outlet aperture 20.

Grooves 3 extending parallel to the longitudinal axis of the screw 1 are formed in the interior surface of the barrel 2. These grooves 3 are preferably triangular in cross-section but may also be rectangular or semi-circular in cross-section. The grooves 3 are continuous, that is to say, they are provided both in feed region 4 and in pin-barrel region 5 of the device.

In the pin-barrel region 5, pins 6 extend into the interior of the barrel 2. The pins 6 extend radially towards the longitudinal axis of the screw 1 and extend to the base of the thread of the screw 1. The pins 6 are associated with gaps 7 formed in helically extending flights 8, the flights 8 defining the thread of the screw 1. The width of the gaps 7 corresponds to the diameter of the pins 6.

The pins 6 are screw-threadedly fitted into the press barrel 2 and are retained by means of nuts 9. The depth to which each pin 6 is screwed into the press barrel 2 is adjustable so that the distance between the tip of the pin and the core of the screw 1 can be varied.

Figure 2:
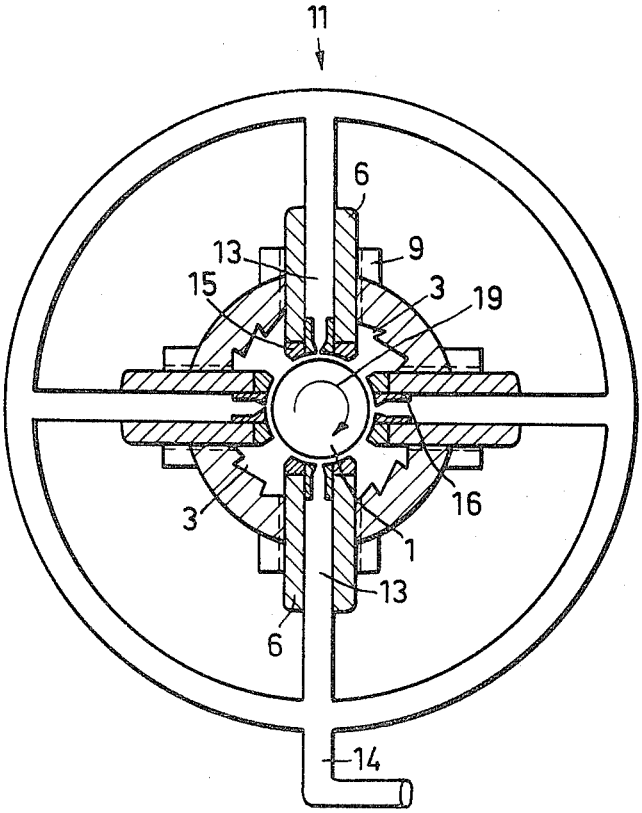
FIG. 2 is a cross-sectional view taken along the line II—II in FIG. 1.

The pins 6 are combined to form individual pin planes 10, 11 and 12. The pin plane 11 is shown in cross-section in FIG. 2. In such embodiment four pins 6 are provided at equiangularly spaced intervals around the periphery of the screw, which pins have been combined to form the pin plane. It will, however, be readily apparent that considerably more individual pins 6 may be disposed around the periphery of the worm and combined into a pin plane. The number of pins employed is dependent on the liquid, usually water, content of the material to be extracted.

An axial discharge bore 13 is formed in each of the pins 6, the bores 13 being connected to a discharge network 14.

When the extraction device is not extracting material, the tips of the pins do not touch the screw 1. If, however, pressure builds up in chamber 18, that is to say, the interior of the barrel 2, then the possibility of the end surfaces 15 of the pins 6 touching the worm cannot be excluded.

The end or sliding surfaces 15 of the pins 6 facing the core of the screw may therefore be made of a material which has dry-running properties or may be made of bronze in order to reduce wear phenomena.

Small bore tubes 16 may be inserted in the ends of the discharge bores 13 located adjacent the core of the screw. These tubes 16 taper conically inwards in a direction towards the core of the screw 1. The conical design of the tubes 16 prevents blocking of the bores 13 because solid components can only enter the bores 13 if they are smaller than the gap between the sliding surface 15 of the pins and the core of the screw 1.

A mixture of liquids and solids is introduced through a funnel 17 into the chamber 18 defined between the individual worm flights 8 and the internal surface of the barrel 2 and, as previously mentioned, is conveyed in the direction of the outlet aperture 20 by the rotational movement, in the direction of screw 19, of the worm 1.

In the feed region 4, the material is subjected to a first compression, and liquid which is easily extractable from the mixture flows into a collection vessel 22 through filter apertures 21. Thereafter, the material is conveyed into the pin-barrel region 5 where it is prevented from rotating with the screw by the pins 6 which protrude into the press barrel 2. Material therefore tends to accumulate, for a short time, upstream (in the direction of flow of the material) of the pins 6. The pressure in the screw thread therefore increases. Such material in the thread will only progress, due to the pressure of mixture components upstream thereof, when the rotating screw thread passes a free portion of the internal periphery of the barrel 2, that is to say, a portion which is not obstructed by pins 6.

Since the grooves 3, which extend parallel to the longitudinal axis of the screw, are disposed between the individual pin planes 10, 11 and 12, the material to be extracted is also prevented from rotating with the screw between such pin planes. This is because material is pressed into the grooves 3 and is prevented from rotating with the screw 1. However, the material is subjected to a rolling movement. Because of this, and due to the retarding effect of the pins 6 on the mixture, a pressure builds up which causes the screw to produce a higher throughput. The increase in the conveying output leads, of necessity, to a considerable increase in pressure in the chamber 18 of, for example, up to 500 bars, especially in the regions between the pin planes 10, 11 and 12.

The greatest pressure on the material to be extracted is therefore exerted in the pin-barrel 5 whereby the water in the cells of the solid components is released. The dry-substance content of the material can thus be increased to about 90% in a single continuous operation although this depends on the material being processed.

The outlet aperture 20 is sealable by means of pressure-loaded cone 23 which causes the outlet aperture 20 to open only when a specific, preselected, pressure has been reached. Because of this provision, a further pressure increase is also produced in the pin-barrel region 5.

The most essential pre-requisite for a high degree of water extraction from a liquid-solid mixture is, however, the provision of the discharge bores 13 extending axially in the pins 6, because this provides a means for the discharging liquid which has been extracted in the region of the extraction device it has been produced. In particular, the water contained in the cells of the solid components is extracted due to the very high pressure and discharged from the device in substantially the same region.

It is also highly desirable to discharge the extracted liquid, from the site of extraction, if this is possible, whilst preventing the liquid from re-mixing with the solid matter to any appreciable extent.

By providing the discharge bores 13 in the pins 6, it is possible for the water or liquid contained in the cells and extracted therefrom to be discharged without any substantial loss of pressure occurring in the pin-barrel region 5. Conversely, the high build-up of pressure necessary for the extraction of the cell water or liquid permits the attainment of high dry-substance contents.

As an example, beet leaves were inserted into the funnel 17 and passed continuously through the extraction device. A dry substance content of 40% was achieved in a single passage, which is an extremely high output.

Figure 3:
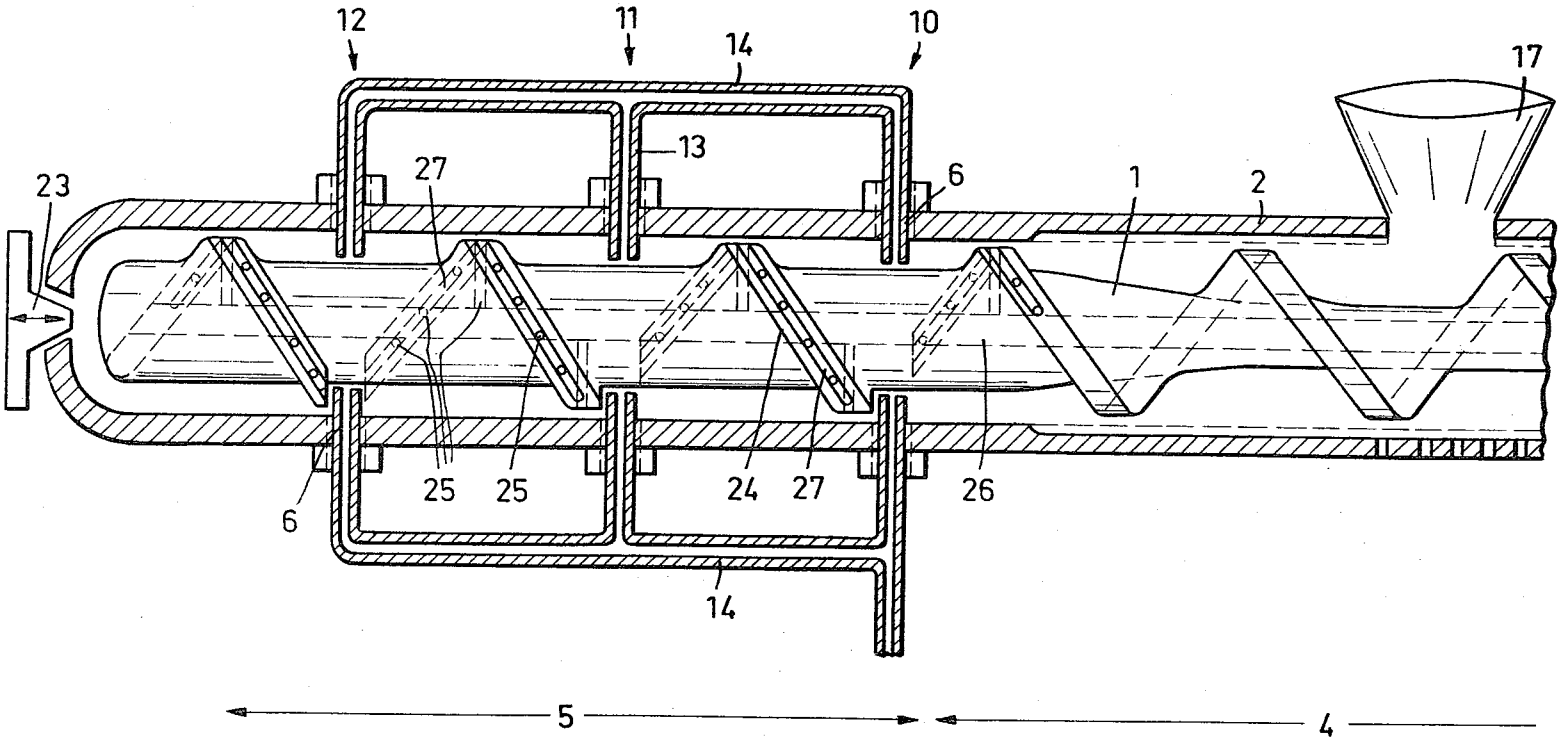
FIG. 3 is a diagrammatic longitudinal section through a slightly modified embodiment of the device.

FIG. 3 shows a slightly modified device, wherein the pins 6 having discharge bores 13 are disposed between the helical flight portions, now referenced 24. However, the ridges of the flight portions 24 have radially inwardly extending bores 25 formed therein, the bores 25 communicating with an axial bore 26 formed in the interior of the core of the screw 1.

The flight portions 24 in FIG. 3 may also be provided with a groove 27 extending along the ridge thereof, which collects any liquid flowing over the flight 24 and conveys it to the radial bores 25. The groove 27 therefore ensures that any liquid flowing over the flight 24 is collected and discharged.

The device shown in FIG. 3 therefore has the advantage that extracted liquid, which collects in the bottom of the screw thread, can flow away through the discharge bores 13 formed in the pins 6, which pins extend to the bottom of the screw thread. The extracted cell water, which should be located on the opposite side of the internal surface of the press barrel 2, may flow away, via the worm flight 24, into the ridge groove 27, thence into the bores 25 and the axial bore 26 in the screw 1.

Such an arrangement of the pins 6 therefore creates a plurality of different discharge channels for the extracted liquid in the screw thread. Because of the very high drop in pressure, the liquid finds its way independently between the screw thread and the discharge channels. The drop in pressure also ensures that smaller solid components are expelled from the various channels.

I claim:

1. Apparatus for separating liquid components from solid components of a liquid-solid mixture, comprising (a) a hollow press barrel defining a relatively low pressure feed region and a relatively higher pressure pin-barrel region, (b) a drivable screw rotatable in said barrel, said screw having a longitudinal axis, a base, and a screw flight helically disposed thereon, said screw flight being formed with axially spaced gaps extending radially entirely around the screw base in the areas of said gaps, (c) a plurality of radially inwardly directed pins passing into said pin-barrel region of said press barrel, the radially inner ends of said pins extending substantially to said base of said screw thread in the regions of said axial gaps and forming narrow radial gaps with said screw base, the presence of said pins in said pin-barrel region effecting a substantial buildup of pressure in such region thereby resulting in the release of liquid from said mixture, the diameter of each said pin being less than the length of the adjacent axial gap so as to permit rotation of said screw, each said pin having an axially extending throughbore including a first, open end adjacent the base of said screw and a second end remote from said screw base, said throughbores being at substantially atmospheric pressure, the radial dimension of said radial gaps being such that the liquid can be extracted and discharged through said throughbores without any substantial drop in pressure in said pin-barrel region and without clogging of said throughbores, and (d) discharge network means, also at substantially atmospheric pressure, in fluid flow communication with said second end of each said bore.

2. Apparatus as recited in claim 1, wherein said press barrel has an internal surface defining at least one groove region, said pins extending into said barrel through said internal surface into said at least one grooved region.

3. Apparatus as recited in claim 1, wherein said plurality of pins are combined to form one or more radial pin planes, each said plane extending transversely to said longitudinal axis of said screw, said pins in each said plane being disposed at equiangularly spaced intervals around said external surface of said press barrel, each said pin being screw-threaded, with the depth of insertion of each said pin into said hollow barrel therefore being adjustable.

4. Apparatus as recited in claim 1, wherein each said tip portion is capable of sliding on said base of said screw and is made of a material having dry-running properties.

5. Apparatus as recited in claim 4, wherein said tips of said pins are made of bronze.

6. Apparatus as recited in claim 1, further including tubes inserted into said first, open ends of said bores and terminating at the radially inner ends thereof, each tube tapering conically inwardly in a direction towards said screw.

7. Apparatus as recited in claim 1, wherein at least the portions of said pins extending into said hollow interior of said press barrel are of rectangular or polygonal cross-section.

8. Apparatus for separating liquid components from solid components of a liquid-solid mixture, comprising (a) a hollow press barrel defining a relatively low pressure feed region and a relatively higher pressure pin-barrel region, (b) a drivable screw rotatable in said barrel, said screw having a longitudinal axis, a base having an axial bore formed therein, and a screw flight helically disposed thereon, said flight being formed with radially extending bores therein in fluid flow communication with said axial bore, said screw flight being formed with axially spaced gaps extending radially entirely around the screw base in the areas of said gaps, (c) a plurality of radially inwardly directed pins passing into said pin-barrel region of said press barrel between helical portions of said flight, the radially inner ends of said pins extending substantially to said base of said screw thread in the regions of said axial gaps and forming narrow radial gaps with said screw base, the presence of said pins in said pin-barrel region effecting a substantial buildup of pressure in such region thereby resulting in the release of liquid from said mixture, the diameter of each said pin being less than the length of the adjacent axial gap so as to permit rotation of said screw, each said pin having an axially extending throughbore including a first, open end adjacent the base of said screw and a second end remote from said screw base, said throughbores being at substantially atmospheric pressure, and (d) discharge network means, also at substantially atmospheric pressure, in fluid flow communication with said second end of each said bore.

9. Apparatus for separating liquid components from solid components of a liquid-solid mixture, comprising:

(a) a hollow press barrel defining a relatively low pressure feed region and a relatively higher pressure pin-barrel region, (b) a drivable screw rotatable in said barrel, said screw having a longitudinal axis, a base, and a screw flight helically disposed thereon, said screw flight being formed with axially spaced gaps extending radially entirely around the screw base in the areas of said gaps, (c) a plurality of radially inwardly directed pins passing into said pin-barrel region of said press barrel, the radially inner ends of said pins having tip portions shaped in accordance with the curvature of the base of said screw and extending substantially to said base in the regions of said axial gaps and forming narrow radial gaps with said screw base, the presence of said pins in said pin-barrel region effecting a substantial buildup of pressure in such region thereby resulting in the release of liquid from said mixture, the diameter of each said pin being less than the length of the adjacent axial gap so as to permit rotation of said screw, each said pin having an axially extending throughbore including a first, open end adjacent the base of said screw and a second end remote from said screw base, said throughbores being at substantially atmospheric pressure, and (d) discharge network means, also at substantially atmospheric pressure, in fluid flow communication with said second end of each said bore.

10. Apparatus for separating liquid components from solid components of a liquid-solid mixture, comprising:

(a) a hollow press barrel defining a relatively low pressure feed region and a relatively higher pressure pin-barrel region, (b) a drivable screw rotatable in said barrel, said screw having a longitudinal axis, a base, and a screw flight helically disposed thereon, said screw flight being formed with axially spaced gaps extending radially entirely around the screw base in the areas of said gaps, (c) a plurality of radially inwardly directed pins passing into said pin-barrel region of said press barrel, the radially inner ends of said pins extending substantially to said base of said screw thread in the regions of said axial gaps and forming narrow radial gaps with said screw base, said radial gaps being approximately 0.3 mm., the presence of said pins in said pin-barrel region effecting a substantial buildup of pressure in such region thereby resulting in the release of liquid from said mixture, the diameter of each said pin being less than the length of the adjacent axial gap so as to permit rotation of said screw, each said pin having an axially extending throughbore including a first, open end adjacent the base of said screw and a second end remote from said screw base, said throughbores being at substantially atmospheric pressure, and (d) discharge network means, also at substantially atmospheric pressure, in fluid flow communication with said second end of each said bore.

* * * * *